United States Patent [19]

Anderson

[11] 4,398,602

[45] Aug. 16, 1983

[54] GRAVITY ASSISTED SOLVENT FLOODING PROCESS

[75] Inventor: Maynard L. Anderson, Dallas, Tex.

[73] Assignee: Mobil Oil Corporation, New York, N.Y.

[21] Appl. No.: 291,748

[22] Filed: Aug. 11, 1981

[51] Int. Cl.[3] ..... E21B 43/24; E21B 43/30; 166 273

[52] U.S. Cl. ..... 166/245; 166/263; 166/272

[58] Field of Search ..... 166/245, 266, 272, 273, 166/274, 263

[56] References Cited

U.S. PATENT DOCUMENTS

| | | | |
|---|---|---|---|
| 1,921,358 | 8/1933 | Hill et al. | 166/263 |
| 2,798,556 | 7/1957 | Binder, Jr. et al. | 166/236 X |
| 2,862,556 | 12/1958 | Tek | 166/263 X |
| 2,969,226 | 1/1961 | Huntington | 166/272 X |
| 3,280,904 | 10/1966 | Closmann et al. | 166/263 |
| 3,459,265 | 8/1969 | Buxton et al. | 166/272 X |
| 3,500,916 | 3/1970 | van der Knapp et al. | 166/272 |
| 3,983,939 | 10/1976 | Brown et al. | 166/272 X |
| 4,007,785 | 2/1977 | Allen et al. | 166/272 X |
| 4,026,358 | 5/1977 | Allen | 166/272 X |
| 4,068,716 | 1/1978 | Allen | 166/272 X |
| 4,166,503 | 9/1979 | Hall et al. | 166/263 |

FOREIGN PATENT DOCUMENTS

| | | | |
|---|---|---|---|
| 1025350 | 1/1978 | Canada | 166/272 |
| 1112956 | 5/1968 | United Kingdom | 166/272 |

*Primary Examiner*—Stephen J. Novosad
*Assistant Examiner*—George A. Suchfield
*Attorney, Agent, or Firm*—Charles A. Huggett; James F. Powers, Jr.; John K. AboKhair

[57] ABSTRACT

This invention relates to a method where the soak time, required for solvent and crude oil mixing in the gravity assisted solvent flooding process, is significantly reduced. This is accomplished by inducing vertical flow of solvent into the heavy crude oil part of the reservoir through the use of intermediate wells drilled between injection and production wells and completed in the top of the oil reservoir. Steam or gas may be used prior to the introduction of the solvent to reduce the resistance to subsequent solvent flow.

14 Claims, 1 Drawing Figure

GRAVITY ASSISTED SOLVENT FLOODING PROCESS

BACKGROUND OF THE INVENTION

1. Field of the Invention

The present invention relates to an improved method for recovering hydrocarbons from a subterranean hydrocarbon-bearing formation containing low-gravity viscous oils or bitumens. More particularly, the invention relates to the recovery of viscous heavy oils from subterranean formations containing same by substantially reducing the soak time required in a miscible flood process.

2. Description of the Prior Art

There are many subterranean, petroleum-containing formations in various parts of the world from which substantial amounts of petroleum cannot be recovered because the viscosity of the petroleum is so great that it is essentially immobile at reservoir conditions. Thus, even if the formation contains adequate permeability, and an extraneous fluid such as water is introduced into the formation to drive the petroleum to a production well, little or no petroleum can be recovered from the formation because the viscosity of the petroleum is so great that it will not move. It is generally recognized that if the API gravity of the petroleum contained in the subterranean formation is less than about 25°, little or no recovery of the petroleum may be accomplished by conventional primary and secondary recovery means.

One of the most extreme examples of viscous petroleum containing formations from which essentially no production may be achieved by conventional primary or secondary means are the so called tar sands or bitumen sand deposits such as those located in the western United States, and the Athabasca Tar Sands in the northern portion of the province of Alberta, Canada, as well as in Venezuela. The viscosity of the bituminous petroleum contained in the Athabasca tar sand deposits, for example, is in the range of several million centipoise at the average formation conditions, thus, rendering the bituminous petroleum essentially immobile. Therefore, recovery of the bituminous petroleum from these deposits by any means other than mining has been essentially unsuccessful on any commercial level.

Some conventional thermal recovery methods have been applied to produce viscous hydrocarbons from formations and bitumens from tar sands among which are steam injection, hot water injection and in-situ combustion. Using these thermal methods,the viscous hydrocarbons are heated to temperatures at which their viscosity is sufficiently reduced and their mobility is sufficiently improved so as to enhance their flow through the pores of the formation.

Typically, such thermal techniques employ an injection well and a production well traversing the oil-bearing or tar sand formation. In a steam operation the heat furnished by the injected steam functions to lower the viscosity of the oil, thereby improving its mobility, while the fluid flow of the steam through the formation functions to drive the oil toward the production well from which the oil is produced. In the conventional in-situ combustion operation, characteristically much higher temperatures, i.e., above the ignition temperature of the crude, are obtained than in a steam operation.

Another technique that has been employed to recover viscous hydrocarbons is the use of hydrocarbon solvents. For example, it is well known that aromatic solvents, such as toluene and benzene, are capable of dissolving the heavier hydrocarbon components in heavy oils or bitumens, thereby improving their mobility by dilution. Aromatic solvents are generally more effective than parafinic-type solvents since the asphaltic components of the oils are more soluble in aromatic solvents. The solvents have a beneficial result in that they dilute the crude and thus make the crude more mobile due to the reduction in viscosity. However, their use has not been practical commercially since this process evolves long periods of soak-time to allow the solvent to mix with the crude. Therefore, the critical factor is the soak time needed, and depending on the thickness of the oil zone, the soak time may vary from a year or two up to possibly eight or more years.

It is thus an object of this invention to provide a recovery process wherein the soak time, required for solvent and crude oil mixing in a solvent flooding process, is significantly reduced. A substantial reduction in soak time is highly desirable as it would lead to a significant increase in oil production and allow earlier production, thus improving the process economics.

SUMMARY OF THE INVENTION

This invention relates to a method where the soak time, required for solvent and crude oil mixing in the gravity assisted solvent flooding process, is significantly reduced. This is accomplished by inducing vertical flow of solvent into the heavy crude oil part of the reservoir through the use of intermediate wells drilled between injection and production wells and completed in the top of the oil reservoir. Steam or gas may be used prior to the introduction of the solvent to reduce the resistance to subsequent solvent flow.

BRIEF DESCRIPTION OF THE DRAWING

The drawing depicts a simple facet of the invention by showing a sequence for enhancing vertical flow of the solvent in a gravity assisted solvent flooding process.

DESCRIPTION OF THE SPECIFIC EMBODIMENTS

Figure 1:
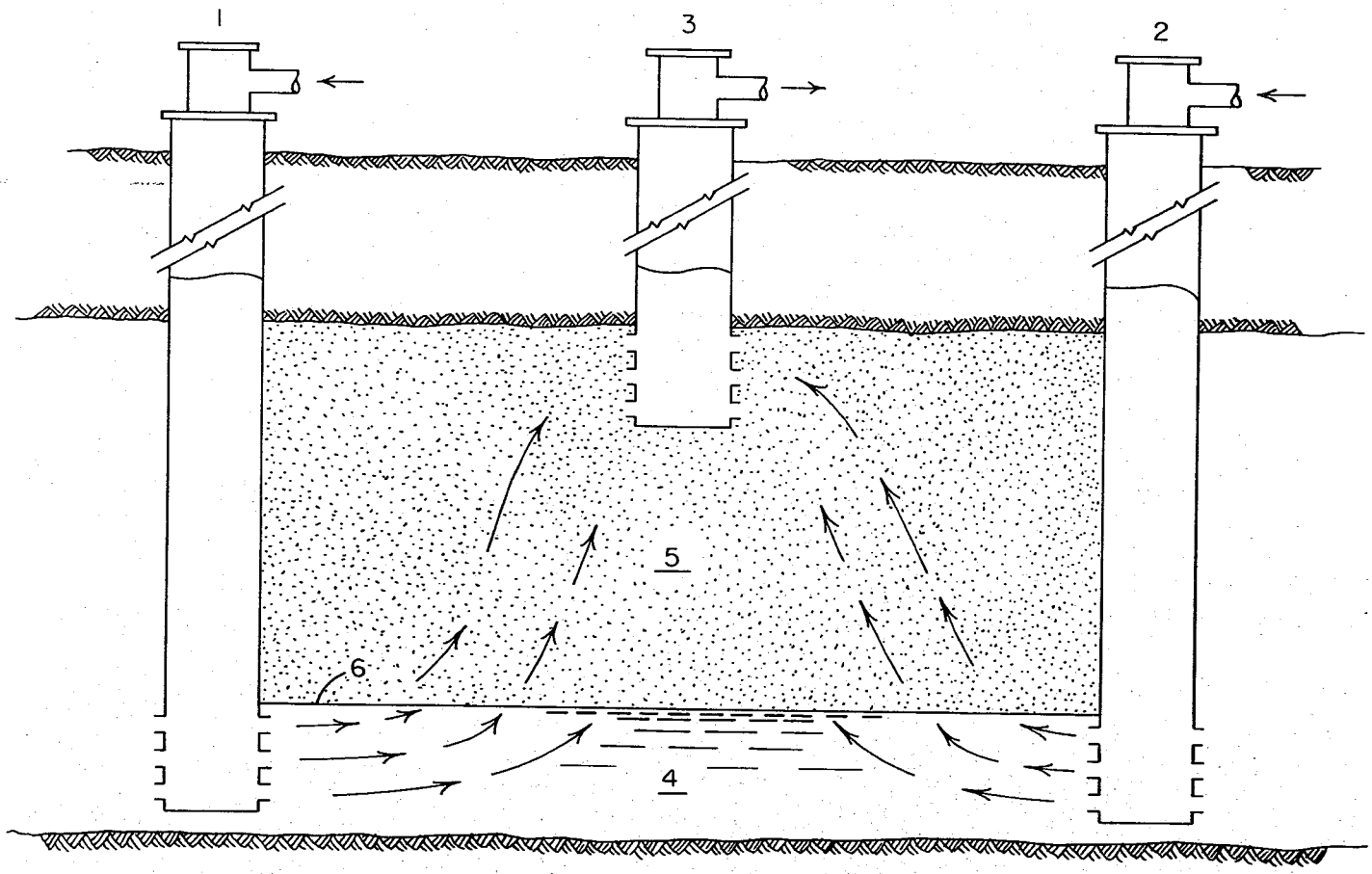

The object of the invention is to significantly reduce the soak time required for solvent and crude oil mixing in a gravity assisted solvent flooding process by inducing vertical flow of solvent into the heavy crude oil part of the reservoir through the use of wells drilled between injection and production wells and completed at least to the top of the reservoir. It is within the scope of the invention to repeat the steps of the invention as a cyclic process and thereafter to scavenge the formation by injection of water. It is also within the scope of the invention to repeat procedure among different patterns in the formation, thereby producing the entire formation by applying the process to successive well patterns. While the invention emphasizes its application to the recovery of heavy oils, it is within the scope of the invention also to apply it to the recovery of bitumens from tar sands. The invention is particularly suitable for the recovery of heavy oils, i.e., those having an API gravity below about 25° API.

In a broad aspect of the invention, a hydrocarbon-bearing formation containing a heavy oil or bitumen and having permeability variations is first traversed by at least one injection well and at least one production well where each well has fluid communication paths between the surface of the earth and a portion of the formation near the bottom thereof. Fluid communication between the wells is established by such methods as conventional hydraulic fracturing if the initial transmissibility of the formation is too low to permit significant fluid injections. At least one more intermediate well is drilled, between the injection and production wells, and completed to have fluid communication path from the surface of the earth and a portion of the formation near the top thereof. It is within the scope of the invention to have more than one intermediate well between the injection and production wells in any well formation. For example, intermediate wells can be drilled between injection and production wells that comprise part of an in-line pattern having a plurality of wells. Another well pattern where the present invention is applicable is where the injection well and production well comprise part of a well pattern including a central injection well and a ring of offset production wells.

After the wells are completed, a solvent or fluid miscible with the visous petroleum which has a specific gravity substantially less than the specific gravity of viscous petroleum is introduced to the lower part of the formation or reservoir. This is generally achieved by injecting the solvent into the water leg, usually present at the bottom of an oil reservoir, through an injection well or wells while producing water from the production wells. The water leg is usually present at the bottom of the oil reservoir, but if not, water can be injected before the solvent to form such a water leg at the bottom of the oil reservoir.

Some of the solvents that are suitable for this application are those having high diffusion coefficients and which are soluble with the oil or bitumens. Typical solvents include aromatic hydrocarbons such as benzene, toluene, xylene and aromatic fractions of petroleum distillates. In addition, such solvents may include saturated hydrocarbons having from two to eight carbon atoms in the molecule such as ethane, propane or LPG, butane, pentane, hexane and cyclohexane. Also mixtures of aromatic and saturated or napthenic hydrocarbons may be used such as gasoline, kerosene, naphtha and gas oils. Mixtures of paraffinic and napthenic hydrocarbons may also be used such as raffinates from an aromatic extraction and debutanized bottoms. The above are examples of suitable solvents and are not to be considered limiting on the present invention.

The size of solvent slug to be used will depend on the solvent chosen and the degree of recovery desired. The degree of recovery desired is a matter of economics and may be determined by those skilled in the art without engaging in inventive effort. As an aid in determining the size of slug needed the following procedure may be used but is not intended to limit the scope of the invention or tie it to any routine calculation procedure. The size of a slug may be calculated by a formula such as:

| | | |
|---|---|---|
| Solubility of bitumen in solvent | × | amount of bitumen per acre foot of formation |
| | × | acre-feet in formation |
| | × | degree of depletion desired (decimal) |

-continued

= amount of solvent required

Routine laboratory experimentation may be used to determine the solubility of a given bitumen in a given solvent and core analysis will yield information on the amount of bitumen per acre foot of formation. Thus, the size of solvent slug for any field may be determined.

After placement of the solvent, pressure is applied to either the injection or production wells or both, and the intermediate wells are opened. The pressuring operation can be conducted with additional solvent or with another fluid, i.e., water. This results in solvent flow from the bottom of the reservoir to the top and greatly increases the surface area between the crude oil and the solvent. Mixing of solvent and crude oil is much more rapid than would be obtained by gravitational force alone because of the added pressure differential. As the light oil or solvent moves up and the heavy oil moves down, an added mechanism, which is molecular diffusion, is present to further enhance mixing. The solvent flooding process results in substantially reducing the viscosity of the heavy oil thus rendering it more produceable. The time needed for this mixing to occur is the soak time which is a major factor in computine the economics of production.

An additional way to practice this invention is to inject a hydrocarbon gas or an inert gas, when the intermediate wells are first opened to create gas saturation in the upper part of the reservoir thereby reducing the resistance to subsequent vertical flow of solvent. Further flow of gas, either continuously or cyclically, along with solvent may be advantageous to promote crude oil and solvent mixing. Steam may also be used as the gas with the added advantage of increasing the mobility of the crude oil due to heating. Examples of suitable gases include carbon dioxide, methane, ethane, nitrogen, air, and flue gas. These are mere examples and are not to be considered limiting on the invention.

In the cases where two or more intermediate wells are present, it may be advantageous to cycle various intermediate wells on and off to promote maximum mixing rate by generation of maximum mass transfer surface area. This manipulation enhances horizontal flow of solvent as well as vertical flow. Control is obtained by monitoring production flow rates from the intermediate wells. By opening and closing these wells at various times, optimum mixing of solvent and crude oil is obtained.

The process of this invention may be illustrated by reference to the accompanying figure which depicts one embodiment of the invention. Other embodiments will, of course, occur to those having had the benefit of the teachings contained herein.

A reservoir containing a very viscous petroleum 5 is penetrated by an injection well 1 having fluid communication with the bottom of the reservoir and a production well 2 having fluid communication with the bottom of the reservoir. Between the injection well and the production well, an intermediate well 3 is drilled and completed to have fluid communications with the top of the reservoir. FIG. 1 represents a point in time where the solvent has been introduced to the bottom of the reservoir 4 through the injection well and pressure is applied through both the production and injection wells while the intermediate well is open. The interface 6 shown between the solvent and the crude oil is, of course, not as distinct as shown.

After the desired mixing of solvent with crude oil has taken place, the intermediate wells are shut, and the oil is produced from the formation through the production wells by known methods, i.e., by water flooding. The production period is continued until the rate indicates the cycle should be repeated. Solvent breakthrough at the intermediate wells may be used as an indication that proper mixing has taken place.

The invention may be applied to any pattern of wells, either as a line drive or a five or nine spot pattern. The method may also be applied sequentially from the section of a reservoir to another, thereby increasing the production of the entire formation. Well patterns and spacings can be determined in accordance with the characteristics of the reservoir and the reservoir fluids.

Although the present invention has been described with specific embodiments, it is to be understood that modifications and variations may be resorted to, without departing from the spirit and scope of this invention, as those skilled in the art will readily understand. Such modifications and variations are considered to be within the purview and scope of the appended claims.

What is claimed is:

1. A method for recovering viscous petroleum from subterranean petroleum containing formations penetrated by at least one injection well and by at least one production well, both wells being in fluid communication with the petroleum containing formation comprising the steps of:

a. drilling and completing at least to the top of the petroleum containing formation at least one intermediate well between the injection and production wells, where said intermediate well has fluid communication with the petroleum containing formation;

b. while the intermediate wells are colsed in, injecting via said injection well and into the lower part of the petroleumcontaining formation a hydrocarbon solvent where said solvent has a specific gravity less than that of the formation petroleum;

c. after the solvent is in place at the bottom of the petroleum containing formation, applying pressure to the injection wells or production wells or both followed by opening the intermediate wells thus enhancing the flow of the solvent from the bottom of the formation to the top; and d. shutting the intermediate wells after desired mixing of petroleum and solvent is achieved, and producing the petroleum and solvent from the production wells.

2. The method of claim 1, wherein step (d) is followed by a secondary or tertiary oil recovery process.

3. The method of claim 1 further comprising the step of injecting a hydrocarbon gas or an inert gas to the bottom of the formation, prior to the injection of the solvent, and opening the intermediate wells to allow the gas to penetrate the formation thus reducing the resistance to subsequent solvent flow.

4. The method of claim 3, where said gas is recycled from the intermediate wells to the injection wells.

5. The method of claim 3 wherein said gas is selected from the group consisting of natural gas, methane, ethane, carbon dioxide, nitrogen, air, flu gas and mixtures thereof.

6. The method of claim 1 further comprising the step of injecting steam to the bottom of the formation, prior to the injection of the solvent, and opening the intermediate wells to allow the steam to penetrate the formation thus reducing the resistance to subsequent solvent flow and reducing the viscosity of the formation petroleum.

7. The method of claim 1 where water or hydrocarbon solvent is used to pressurize one or more wells.

8. The method of claim 1 where two or more intermediate wells are present and where various of said intermediate wells are cycled on and off to promote maximum mixing rate.

9. The method of claim 1 wherein steps (a) through (d) are repeated after production has decreased below an economic level.

10. The method of claim 1 wherein said injection well and said production well comprise part of an in-line pattern having a plurality of wells.

11. The method of claim 1 wherein said injection well and said production well comprise part of a well pattern including a central injection well and a ring of offset production wells.

12. The method of claim 1, where solvent is aromatic, paraffinic, or naphthenic hydrocarbon or mixtures thereof.

13. The method claim 1, where a hydrocarbon gas or inert gas is injected with the solvent.

14. The method of claim 1, wherein said intermediate wells are completed to a level in the oil bearing formation above that of the injection and production wells.

* * * * *